US006473964B1

(12) United States Patent
Anderson et al.

(10) Patent No.: US 6,473,964 B1
(45) Date of Patent: Nov. 5, 2002

(54) METHOD OF FABRICATING CAMSHAFTS

(75) Inventors: Gary L. Anderson, St. Marys, PA (US); John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

(21) Appl. No.: 09/481,419

(22) Filed: Jan. 12, 2000

(51) Int. Cl.[7] ..... B23P 15/00
(52) U.S. Cl. ..... 29/888.1; 29/447; 29/508
(58) Field of Search ..... 29/888.1, 557, 29/447, 508; 419/5, 28; 74/567; 123/90.27, 90.6

(56) References Cited

U.S. PATENT DOCUMENTS

| | | | | |
|---|---|---|---|---|
| 4,211,192 A | | 7/1980 | Baumgartner et al. | |
| 4,462,148 A | | 7/1984 | Joyce | |
| 4,595,556 A | | 6/1986 | Umeha et al. | |
| 4,616,389 A | | 10/1986 | Slee | |
| 4,851,189 A | | 7/1989 | Dönch et al. | |
| 4,969,262 A | | 11/1990 | Hiraoka et al. | |
| 5,043,305 A | | 8/1991 | Tanaka et al. | |
| 5,272,930 A | * | 12/1993 | Nakamura et al. | 29/888.1 |
| 5,280,675 A | * | 1/1994 | Orsini, Jr. | 74/567 |
| 5,392,511 A | * | 2/1995 | Copeland et al. | 29/888.1 |
| 5,469,759 A | * | 11/1995 | Orsini, Jr. | 74/567 |
| 5,531,537 A | | 7/1996 | Pink et al. | |
| 5,540,883 A | | 7/1996 | Jones et al. | |
| 5,613,180 A | | 3/1997 | Kosco | |

FOREIGN PATENT DOCUMENTS

| | | |
|---|---|---|
| DE | 43 07 562 A1 | 9/1994 |
| EP | 0892 156 A1 | 6/1998 |

OTHER PUBLICATIONS

H. Müller and A. Kaiser, "Composite Camshaft–Avoid Lobe Grinding Using Precision PM Lobes", SAE Technical Paper Series, 97001 (1997).

"Thermal Shrink Fit Process for Composite Camshafts", *Automotive Engineering*, (Sep. 1997), pp. 76–78.

"Roller Burnishing", ASM Handbook, vol. 16, Machining (1989), pp. 252–254.

* cited by examiner

*Primary Examiner*—I. Cuda-Rosenbaum
(74) *Attorney, Agent, or Firm*—Kirkpatrick & Lockhart LLP

(57) ABSTRACT

A method of attaching and adjusting first and second members includes providing a first member having an outer surface and a second member. The second member is affixed to the outer surface of the first member at a desired axial position along the length of the first member and in a desired angular orientation. Subsequent to affixing the second member to the first member, the shape and/or dimensions of the second member is adjusted by increasing the density of at least a region of the second member. The densification may be accomplished by, for example, a mechanical working technique such roller burnishing, coining, sizing, shot peening, or laser impacting. In one embodiment of the invention, the method may is adapted to the production of combustion engine camshafts from separately provided camshaft tubes and cam lobes.

68 Claims, 7 Drawing Sheets

METHOD OF FABRICATING CAMSHAFTS

CROSS-REFERENCE TO RELATED APPLICATIONS

Not Applicable.

FEDERALLY SPONSORED RESEARCH

Not Applicable.

TECHNICAL FIELD AND INDUSTRIAL APPLICABILITY OF THE INVENTION

The present invention is generally directed to a method for attaching first and second members, and subsequently adjusting the shape and/or dimensions of at least one of the members. More particularly, the present invention is directed to a method of attaching one or more cam lobes and other individual camshaft elements, such as, for example, sprockets, bearing races and gears, to a camshaft tube at desired axial and angular orientations about the tube, and subsequently adjusting the shape and/or dimensions of at least one of the attached elements. In this way, the cam lobes and components may be adjusted to meet dimensional tolerances necessary for proper assembly of the camshaft into a combustion engine or other apparatus.

The method of the present invention may be utilized in applications wherein it is desirable to attach first and second members and subsequently adjust the shape and/or dimensions of at least one of the members. Examples of such applications include the fabrication of camshafts for internal combustion engines and other applications and the assembly of complex gear forms on rotatable shafts. The present method is particularly useful when applied in the fabrication of camshafts wherein cam lobes and, possibly, other camshaft elements such as sprockets, bearing races, and gears, are installed in precise locations on the outer surface of a camshaft tube. Camshafts fabricated according to the method of the invention may be used to engage push rods, lifters, impellers, rotors, gears, pulleys or other movable members.

DESCRIPTION OF THE INVENTION BACKGROUND

Camshafts for piston-driven internal combustion engines typically include several cam lobes with lobe-shaped outer surfaces that operate to move push rods, lifters, or other movable members in a precise pattern. As the camshaft rotates, the cam lobes must engage the movable members at proper positions and with proper timing. Therefore, the cam lobes must be positioned on the camshaft at precise relative axial positions and angular orientations.

A camshaft 10 of a typical construction adapted for use in an internal combustion engine is depicted in FIG. 1. The camshaft 10 generally includes a camshaft tube 11. Several cam lobes 12 are affixed to the outer surface of the camshaft tube 11. Other camshaft components such as, for example, gear 16, may be affixed to the outer surface of the camshaft tube 11. Although generically referred to herein as a "camshaft tube", that element, although typically hollow, need not be cylindrical and may have any overall shape and uniform or non-uniform cross-section suitable for receiving and rotating the several cam lobes and other camshaft components. Accordingly, "camshaft tube" is used herein to refer generally to the central rotating component of a camshaft to which the cam lobes are affixed and is not limited to any particular cylindrical or non-cylindrical configuration.

The lobe-shaped region of each cam lobe has a predetermined shape and is dimensioned to accurately control movement of the movable member it engages. More specifically, the profile of the cam lobe 12, and particularly the shape and dimensions of the lobe-shaped region 13, are such that as the camshaft tube 11 rotates, the motion of the cam lobe 12 imparts a precise rocking or reciprocating motion to the movable member it engages. In FIG. 1, for example, the movable members illustrated adjacent a cam lobe 12 are a lifter 14 and a push rod 15. As the camshaft 10 rotates, the surface shape and dimensions of each cam lobe 12, along with their various angular and axial positions along the length of the camshaft tube 11, work in conjunction to properly move the push rods 15 of the engine in a desired pattern and timing. This synchronized motion ensures that the intake and exhaust valves of all engine cylinders operate correctly.

Camshafts combining a camshaft tube and several cam lobes traditionally were manufactured as a single component by casting or forging. This method of fabrication is time-consuming and expensive, and produces camshafts with limited dimensional accuracy. Therefore, extensive grinding and/or polishing is required to shape the individual cam lobes and other camshaft components and appropriately adjust the shape and dimensions of the surfaces of each of the components. Absent such extensive finishing work, the cam lobes would not properly engage their associated movable members. Forged or cast camshafts are necessarily composed of material of a substantially homogenous chemical composition. This is a disadvantage inasmuch as it may be desirable for the camshaft tube and the cam lobes to have substantially different physical properties so as to optimally withstand the significantly different mechanical forces experienced by the several components.

To address the deficiencies inherent in the casting and forging methods of camshaft fabrication, more recently camshafts have been fabricated by separately producing the camshaft tube and the cam lobes and then installing the cam lobes onto the outer surface of the camshaft tube at desired locations. In the case of the camshaft 10 of FIG. 1, for example, individual cam lobes 12 having a configuration as generally shown in FIG. 2 may be separately fabricated and then positioned about the camshaft tube 11. The components are assembled by disposing the camshaft tube 11 through the bore 17 in each cam lobe, and then affixing the cam lobes 12 to the outer surface of the camshaft tube 11 in desired axial positions and angular orientations. This fabrication method provides greater flexibility relative to the casting and forging methods, and the materials from which the camshaft tube, the cam lobes, and the other components installed on the camshaft are constructed may differ. For example, the cam lobes may be produced from a material particularly resistant to thermal stress and repetitive contact fatigue, while the camshaft tube may be produced from less expensive material such as a machined mild steel.

Fabricating camshafts by installing separately produced cam lobes onto a camshaft tube has the inherent disadvantage that the cam lobes and other camshaft elements must be precisely positioned when affixed. Also, the surface of each cam lobe must have the required shape and dimensions so that it is precisely oriented relative to each other cam lobe surface and relative to the camshaft tube. Accordingly, when fabricating camshafts in this manner, after the cam lobes are installed on the camshaft tube it is common to grind the surfaces of the cam lobes using one or more grinding steps so as to adjust each cam lobe profile and, possibly, adjust the relative angular orientations of the several cam lobes. In an alternate process, the internal diameter of each cam lobe is ground to adjust the tolerances that will be achieved once the cam lobes have been installed on the camshaft tube. Grinding the internal diameters or exterior surfaces of the cam lobes in a precise manner is problematic and, for example, accurately grinding cam lobes produced from powder metal material can be complex and expensive. More generally, grinding of cam lobes requires the use of expensive grinding machines, is a relatively slow process, and requires expensive grinding wheels that must be replaced often.

Accordingly, a need exists for a method of fabricating camshafts wherein cam lobes produced separately from the camshaft tube may be affixed to the exterior surface of the camshaft tube at precise axial positions and angular orientations, and then the cam lobes may be adjusted to proper shape and/or dimensions without employing a grinding operation. More generally, the inventor perceives that a need exists for a method of attaching first and second members wherein, subsequently, the shape and/or dimensions of at least one of the members may be adjusted by a technique other than grinding.

SUMMARY OF THE INVENTION

The present invention addresses the above-described needs by providing a method of conveniently attaching and adjusting first and second members. The method includes providing a first member having an outer surface and a second member. The second member is affixed to the outer surface of the first member at a desired axial position along the length of the first member and in a desired angular orientation. The second member may be affixed to the first member using any suitable known technique. Such affixation techniques include, for example, shrink fitting, interference fitting, welding, mechanical or chemical fusing, or any other technique for permanently affixing one member onto a surface of another member at a predetermined position and orientation. Subsequent to affixing the second member to the first member, the shape and/or dimensions of the second member is adjusted by increasing the density of at least a region of the second member. The densification may be accomplished by, for example, a mechanical working technique such roller burnishing, coining, sizing, shot peening, or laser impacting.

According to one embodiment of the present invention, the second member includes an aperture that is sized so that the first member may be disposed within the aperture when the second member is at a temperature greater than a predetermined temperature. The second member is heated to a temperature above the predetermined temperature, and the first and second members are then positioned so that the first member is disposed within the aperture of the second member at a desired axial position and angular orientation relative to the first member. The second member is then cooled to a temperature below the predetermined temperature to securely affix the second member to the first member in the desired axial position and angular orientation. The shape and/or dimensions of at least a region of the second member is then appropriately adjusted by increasing the density of at least a region of the second member. As just noted, the densification may be provided by mechanically working a surface of the second member.

The method of the present invention is particularly suited to the fabrication of camshafts and may be applied to attach cam lobes, sprockets, bearing races, gears and other camshaft elements to a camshaft tube. The camshaft tube includes an outer surface that may be, for example, cylindrical or of any alternate, non-cylindrical configuration adapted to the intended use of the camshaft. When the present invention is adapted as a method of fabricating camshafts, at least one cam lobe is provided. The cam lobe is affixed to the outer surface of the camshaft tube at a predetermined axial position and angular orientation. The cam lobe may be affixed to the camshaft tube using any known technique suitable for permanently affixing one metallic member onto a surface of another metallic member at a predetermined position and orientation. Such techniques include, for example, interference fitting and shrink fitting. Other affixation techniques include known techniques of fusing metallic members together by a welding or sintering operation. Once the cam lobe is appropriately affixed to the outer surface of the camshaft tube, the shape and/or dimensions of at least a surface region of the cam lobe is adjusted by densifying at least a region of the cam lobe. The densifying operation may be accomplished by a mechanical working technique such as roller burnishing, sizing, coining, shot peening, and laser impacting, or by any other densification method suitable for adjusting the tolerance of the cam lobe once assembled onto the camshaft tube.

In embodiments of the camshaft fabrication method wherein the cam lobe is affixed to the camshaft tube using a shrink fitting technique, the cam lobe is provided with an aperture therethrough sized so that when the cam lobe is heated above a predetermined temperature the aperture expands and the camshaft tube may be disposed therethrough. The cam lobe is heated to a temperature above the predetermined temperature, and the cam lobe and camshaft tube are then positioned so that the camshaft tube is disposed through the aperture and is at a desired axial position and angular orientation relative to the camshaft tube. The cam lobe is then cooled to reduce the size of the aperture and to securely engage the external surface of the camshaft tube and fix the position of the cam lobe relative to the tube. Once the cam lobe has been affixed to the camshaft tube in this way, at least a region of the cam lobe is densified by, for example, a roller burnishing, sizing, coining, shot peening, or laser impacting technique, or another suitable mechanical working technique. The densification step is carried out so as to appropriately adjusts the shape and/or dimensions of at least a region of the outer surface of the cam lobe to meet required tolerances.

Roller burnishing is a cold mechanical working technique known to those of ordinary skill in the art and consists generally of applying pressure to the part surface by rolling. More particularly, roller burnishing has been applied in other applications to adjust the dimensions of components formed of powder metal and other metallic materials. To the knowledge of the present inventor, however, roller burnishing has not been applied as a means to adjust the tolerances of cam lobes or other components installed on the camshaft tube of an assembled camshaft. When applied to powder metal parts, roller burnishing also may work to harden the surface of the part. Roller burnishing and other mechanical working techniques are not a metal removal technique. Thus, they differ fundamentally from grinding techniques, wherein the shape and/or dimensions of a part are adjusted by removing material from a surface of the part.

In the method of the present invention, any region of the outer surface of the one or more cam lobes of the assembled camshaft may be roller burnished or otherwise mechanically worked or densified to adjust part shape and/or dimensions. In this way, the outer surface of the one or more cam lobes of the camshaft will properly engage the associated moveable member when the camshaft is assembled into a combustion engine or other device. Moreover, roller burnishing or other densification techniques may be employed to adjust the shape and/or dimensions of other components once affixed in proper positions about the camshaft tube using the method of the present invention. Such other components may include, for example, gears, bearing races, and sprockets.

Cam lobes employed in the method of the present invention may be composed of any material having properties suitable for that application. The method of the present invention for fabricating camshafts is, however, particularly suited to the assembly of camshafts from cam lobes formed from metallurgical powders by press-and-sinter techniques. Such cam lobes preferably are produced from a powder metal material that is resistant to wear and rolling contact fatigue, and that may be roller burnished or otherwise densified or mechanically worked to appropriately adjust the shape and/or dimensions of the surface of the cam lobes. The present inventor has found that cam lobes having the following preferred composition, on a weight percentage basis, provide excellent rolling contact fatigue and wear resistance properties: about 90% to about 99.7% iron, 0 to about 2.0% nickel, 0 to about 1.0% molybdenum, about 0.3% to about 2.0% carbon, 0 to about 3.0% copper, and 0 to about 3.0% chromium. It is noted that compositions that are not strictly within the foregoing compositional ranges also may be used to prepare cam lobes according to the present invention. Additional materials that may be used in the production of cam lobes according to the method of the present invention will be apparent to those of ordinary skill in the art on considering the present description of the invention. Thus, the foregoing preferred metal powder composition should not be considered to limit the scope of the present invention.

The reader will appreciate the foregoing details of the present invention, as well as others, upon consideration of the following detailed description of embodiments of the invention. The reader also may comprehend such additional details upon using the invention.

DETAILED DESCRIPTION OF EMBODIMENTS OF THE INVENTION

The present invention is broadly directed to a method of attaching a first member and a second member and subsequently adjusting the shape and/or dimensions of at least one of the members by increasing the density of at least a region of that member. To illustrate the method of the present invention, the following detailed description is principally drawn to certain embodiments of the invention in the form of methods of fabricating a camshaft for a piston-driven internal combustion engine. The following description of that embodiment of the invention is provided merely to illustrate the invention and is not intended to limit the invention. One skilled in the art will readily envision other applications of the invention after having considered the present description, and the broader scope of the invention is better described in the appended claims.

Figure 1:
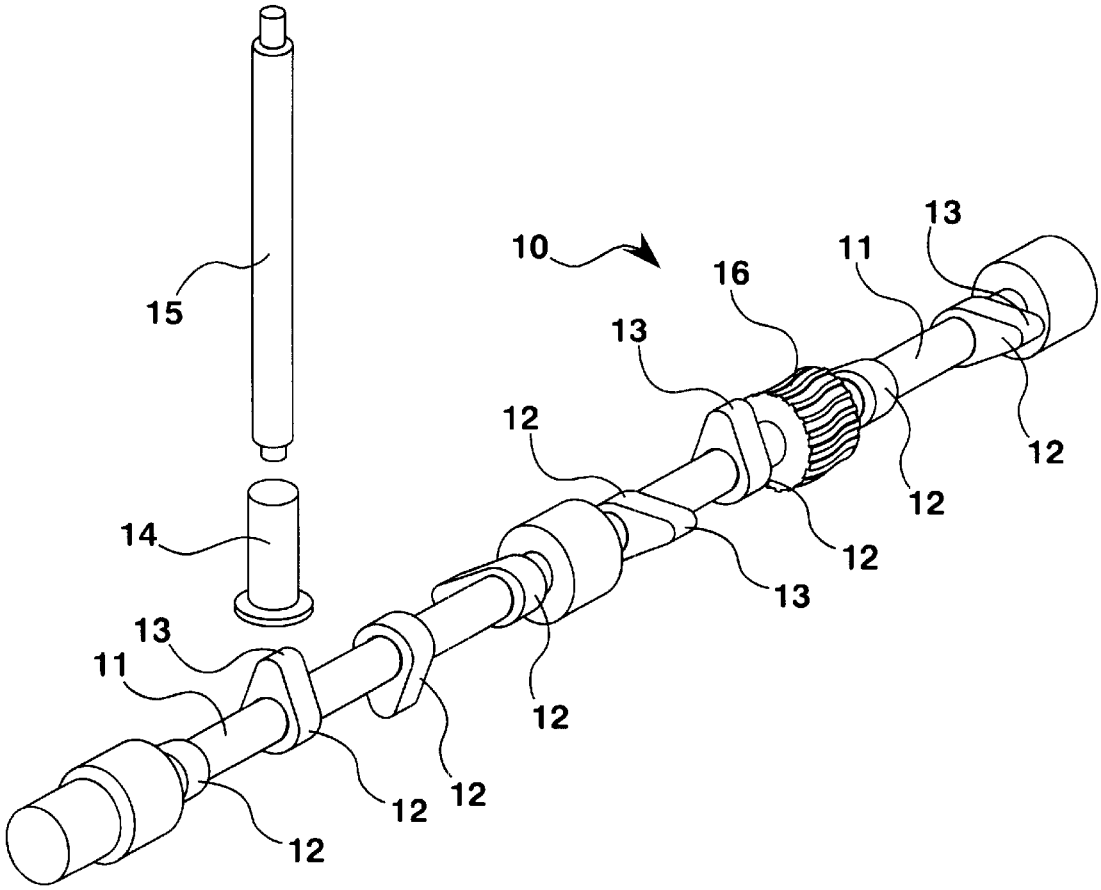
FIGURE 1 (Prior Art)
FIG. 1 is a perspective view of a conventional camshaft.
Figure 2:
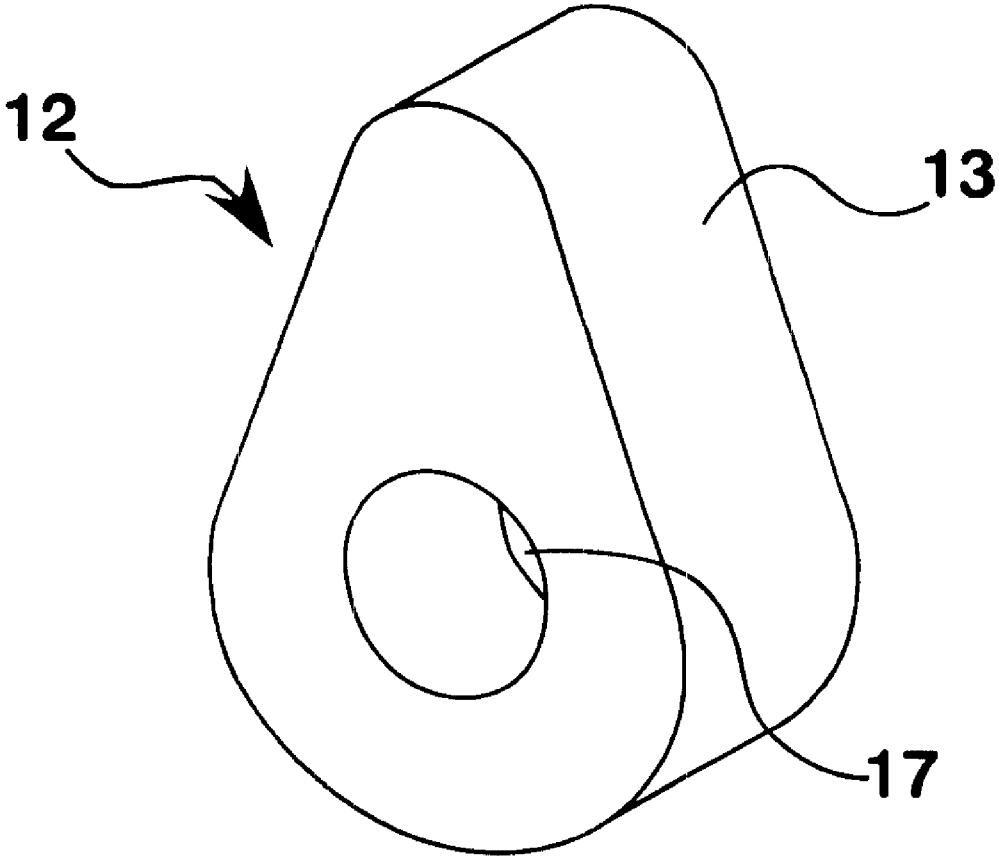
FIG. 2 is a side elevational view of a conventional cam lobe used in the assembly of camshafts.
Figure 3:
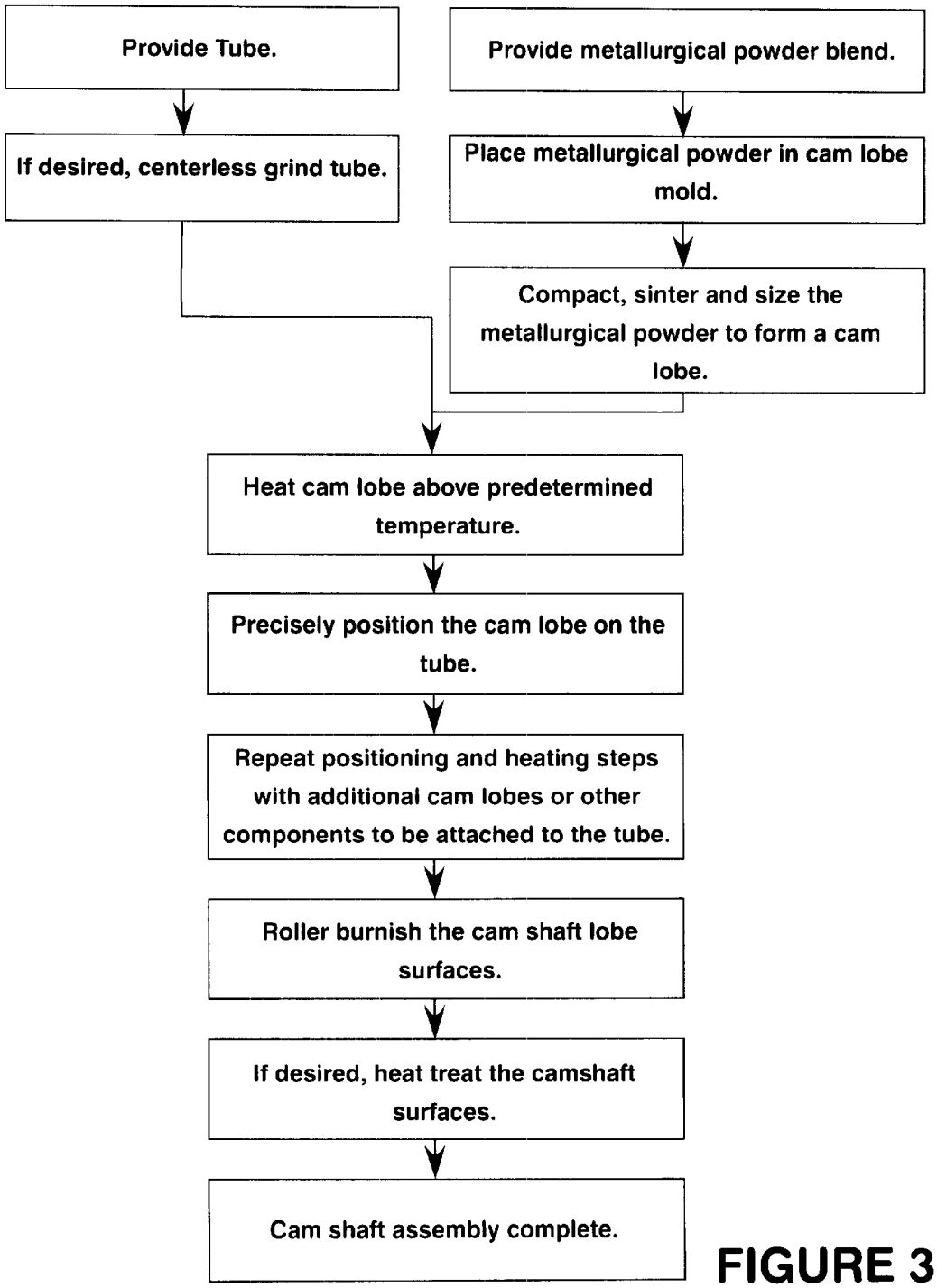
FIG. 3 is a flow diagram illustrating generally an embodiment of a method of fabricating a camshaft according to the present invention.

The camshaft fabrication method embodiment is shown schematically in the flow diagram of FIG. 3. The first steps of the fabrication method include separately providing a camshaft tube, one or more cam shaft lobes, and any additional camshaft components to be installed on the outer surface of the camshaft tube. As noted in FIG. 3, optionally the surface dimensions of the camshaft tube may be prepared for the succeeding method steps by a grinding operation. The grinding operation may be, for example, a high speed centerless grinding operation. Such a grinding step is desirable for applications in which the dimensions of the camshaft tube must be exact, such as where the camshaft tube surface will be employed as a bearing race. The camshaft tube may be, for example, an elongated metal cylinder having an internal and external diameter. It will be understood, however, that the camshaft tube may have any configuration appropriate to its intended application including, for example, non-cylindrical and non-symmetric configurations, as well as configurations having either constant or non-constant cross-sections. As discussed in detail below, the outer surface of the camshaft tube will receive each cam lobe, and each cam lobe is affixed at a precise axial position and the angular orientation on the tube's outer surface.

In the embodiment of FIG. 3, the cam lobes (and possibly other camshaft components) to be affixed to the outer surface of the camshaft tube are formed from powder metal. Powder metal fabrication techniques allow flexibility in selecting the properties of the cam lobes and other components and allow for near-net shapes to be formed. For example, powder metal fabrication techniques may be selected to provide the cam lobes with a high degree of wear resistance so that they maintain desired shapes over prolonged periods. In the present method, the material from which the cam lobes are fabricated preferably also should exhibit a certain degree of machinability so that regions of the cam lobes may be densified to adjust each of the cam lobes to desired shape and/or dimensions. The manner of densification may be, for example, by mechanical working such as by roller burnishing or the other working techniques mentioned herein.

The inventor has discovered that a powder metal material having the following elemental composition, in weight percentages based on total weight of material, is particularly well-suited for the production of camshaft cam lobes for use in piston-driven internal combustion engines: 90% to 99.7% iron, 0 to 2.0% nickel, 0 to 1.0% molybdenum, 0.3% to 2.0% carbon, 0 to 3.0% copper, and 0 to 3.0% chromium. Cam lobes formed using powder metal fabrication techniques from powders having the above elemental composition by the method of the present invention exhibit rolling contact fatigue endurance limits in the 200–300 ksi range when tested at 20 million cycles. The cam lobes also may be heat treated to attain hardness in the RC30–45 range, which provides adequate wear resistance under repetitive rolling/ sliding contact under heavy loads. The foregoing properties are particularly important to the proper functioning of cam lobes, which are subjected to high cyclic stresses and heavy loads for prolonged periods.

The preferred powder compositional ranges set forth above should not be considered to limit the scope of the method of the present invention. It is believed that powder compositions outside the above compositional ranges also may be used in the method of the present invention to form cam lobes having acceptable rolling contact fatigue and wear resistance properties. For example, it is believed that acceptable properties may be achieved if the powders include nickel and/or molybdenum in excess of 2.0% and 1.0% upper limits, respectively, indicated above, but the cost of such powders would be increased without a significant increase in rolling contact endurance limit or hardness in the finished material. Nevertheless, powder mixes including copper, nickel, and/or molybdenum in amounts in excess of the above preferred ranges may be desirable to provide an improvement in properties other than rolling contact endurance or wear resistance. Such other properties include, for example, tensile strength and dimensional control.

Sinterhard powders also may be used in the method of the present invention to fabricate cam lobes or other components that are to be installed on the camshaft tube. Sinterhard powders include a balance of carbon and alloying elements that will form parts having hardnesses greater than about RC 25 directly from the sintering furnace after cooling at cooling rates that may be achieved in the furnace. Parts having hardnesses in excess of RC 25 are typically produced from sinterhard powders using a sintering furnace that is specially designed to gas cool the sintered parts at an accelerated rate, in the 120–200° F./min. range. More recently, high-alloy content sinterhard powders have been developed that provide hardnesses greater than RC 25 on cooling at the much lower rate of about 40° F./min.

More generally, it is preferred that the powders used in the method of the present invention will develop a hardness less than RC 20, and more preferably less than RC 12, after an initial press and sinter. It also is preferred that such sintered parts are capable of developing hardnesses in the RC 30–60 range after a heat treatment subsequent to the press and sinter. The relatively low pre-heat treatment hardness (less than RC 20) allows the material to be easily deformed to adjust tolerances, while the much higher hardnesses achieved on heat treating the material provide the material with wear resistance adequate to withstand cyclic sliding under heavy loads. Preferred powders also are those that may be formed by the method of the present invention into materials that exhibit tensile strengths in excess of 80 ksi and rolling contact endurance limits greater than 225 ksi after heat treatment. As used herein, the rolling contact endurance limit is the greatest cyclic load able to be withstood by a part without failure for 20 million rolling contact cycles.

With regard to providing the several cam lobes, the method shown in FIG. 3 includes the steps of providing the desired metallurgical powder, providing a mold in the desired cam lobe profile, placing the metallurgical powder into the mold, and then compacting, sintering, and optionally, sizing or coining the metallurgical powder to provide a near-net shape cam lobe. Other camshaft components that are to be affixed on the outer surface of the camshaft tube may be fabricated by a similar powder metal technique to provide components with desired properties. Although it is preferred that the cam lobes and other components that are to be affixed to the camshaft tube are fabricated by powder metal techniques, it will be understood that any suitable alternate fabrication technique known in the art may be used. Such alternate techniques include, for example, casting, forging and machining.

A more specific example of a process for fabricating cam lobes that may be used in the method of the invention is as follows. A metallurgical powder having a composition within the preferred compositional range set out above is compacted in a cam lobe mold at a pressure greater than 25 tons per square inch (tsi). The green compact is then sintered at a temperature greater than 2000° F. If further dimensional accuracy or density is desired, the sintered compact may be repressed or sized at a pressure greater than 30 tsi. Experience has shown that applying such press, sinter, and repress conditions to powders within the above-described preferred compositional ranges yields a cam lobe having a density of between 6.8 to 7.4 grams/cc. A more specific example of a possible press, sinter, and repress technique that may be used to produce the cam lobes and other components is the method described in U.S. Pat. No. 5,613,180. Powder metal material produced according to the method of the '180 patent, known commercially as "HFA" material, is available from Keystone Powdered Metal Company, St. Marys, Pa. HFA material is carburized, quenched, and tempered and is characterized by a high carbon (about 0.6–0.9%) surface region and a low carbon (about 0.1–0.4%) case.

The density of the cam lobes and other components produced in the method of the invention by powder metal fabrication techniques may be increased by including additional steps in the fabrication. For example, cam lobes with a density in the range of 7.2 to 7.6 g/cc may be produced by molding a metallurgical powder of the above preferred composition at a pressure greater than 40 tsi, pre-sintering the green compact at a temperature in the range of 1550 to 1750° F., and then sizing the sintered compact at a pressure greater than 50 tsi. The sized part is then sintered at a temperature greater than 2000° F., and is subsequently re-sized at a pressure greater than 30 tsi.

Figure 7:
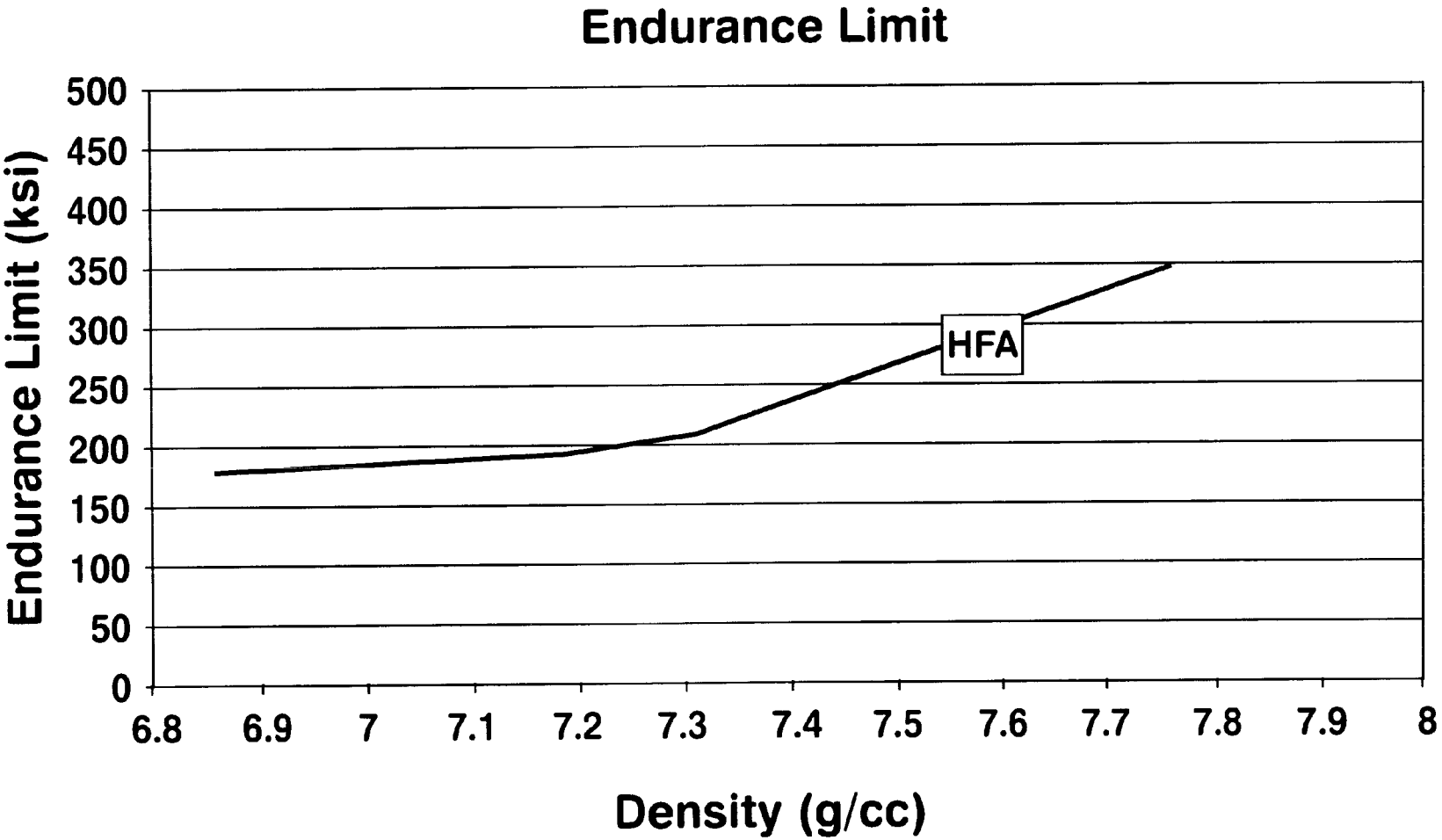
FIG. 7 is a plot of rolling contract endurance limit as a function of density of powder metal materials derived from testing of powder metal materials produced by several known powder metal fabrication techniques.

Increasing the density of the cam lobes and other components enhances the components' rolling contact endurance limits. Higher densities also enhance the mechanical properties of the core of components, which is desirable in components used in applications such as cam lobes. The effect of increased density on rolling contact fatigue properties is illustrated in FIG. 7, which is a plot of rolling contact endurance limit versus density. The curve was generated using data from powder metal materials produced by several known powder metal fabrication techniques. HFA material, for example, is indicated on the graph to have relatively high density and, consequently, typically has a relatively high endurance limit, in excess of 225 ksi.

After the camshaft tube and the cam lobes and other components to be affixed to the camshaft tube have been provided, the camshaft is assembled. In the embodiment of the method of the present invention shown in FIG. 3, each cam lobe and other component to be mounted on the outer surface of the camshaft tube includes an aperture. The aperture of each cam lobe and other components is sized such that the camshaft tube may be disposed through the aperture and the component properly positioned thereon only if the component has first been heated to a temperature above a predetermined temperature. During the assembly process, the camshaft tube remains at or near ambient temperature. When heated above the predetermined temperature, the aperture through the particular component expands to a size that will allow the camshaft tube to be disposed therethrough. Once properly axially and angularly positioned, the heated component is then cooled, the component's aperture shrinks and forcefully contacts the camshaft tube's outer surface, and the component is thereby secured in the selected position. In that way, one or more cam lobes and/or other component is affixed about the camshaft tube by a shrink fit.

As further indicated in FIG. 3, each cam lobe and other component is first heated to a temperature necessary to expand the apertures therethrough so that the camshaft tube may be disposed through the apertures and the components positioned at desired axial positions and angular orientations about the camshaft tube. Cam lobes fabricated from metallurgical powders by one of the techniques described immediately above typically must be heated to above 500° F. Of course, the temperature above which a particular component must be heated may be readily determined by actual testing in advance of assembling the camshaft. Above the predetermined temperature, the aperture of the cam lobe or other component may be positioned about the camshaft tube and precisely axially positioned and angularly oriented. The cam lobe is then cooled. The cooling step shrinks the aperture, providing a shrink fit with the external surface of the camshaft tube. The cooling may be accomplished by, for example, spraying liquid nitrogen or liquid carbon dioxide in the inner diameter of the camshaft tube, if hollow, to indirectly cool the components affixed thereto. Cooling also may be accomplished by directly spraying the above-mentioned liquids, or by directing a cooled gaseous stream or a cooled air and water spray, onto the surface of the heated cam lobe or other component. It will be understood that any other suitable method of cooling that will cause the components' apertures to shrink may be used.

The several cam lobes and other components may be individually affixed about the camshaft tube by the above shrink fit technique in precise axial positions and angular orientations. In an alternate technique for assembling the cam shaft components, the cam lobes and other components may be secured in jigs located at precise relative positions and so that the apertures in the several components are coaxially aligned. The components are then heated by electrical induction or another technique to a temperature at which their apertures have suitably expanded to receive the camshaft tube. The camshaft tube is then disposed through the aligned apertures to a precise position relative to the several heated components, and the components are then cooled to shrink fit the components about the outer surface of the camshaft tube. Other shrink fit assembly sequences will be apparent to one of ordinary skill upon considering the present description of the invention, and all such sequences are intended to be encompassed by the appended claims.

Other techniques for affixing cam lobes and other camshaft components to the camshaft tube may be used in place of the above-described shrink fit technique. For example, the components may be welded or otherwise fused or bonded to the outer surface of the camshaft tube. In such cases, the cam lobes need not be formed with an aperture for the camshaft tube. Another alternate affixation technique is to thread the internal diameter of the aperture through the cam lobes and other components, and then force the components onto the camshaft tube to deform the threads and mechanically securely affix elements together. It will be understood that any suitable technique to affix the cam lobes and other camshaft components to the outer surface of the camshaft tube may be used. Thus, the fact that a shrink fit means of attachment is utilized in the embodiment of FIG. 3 should not be considered to limit the scope of the present invention.

Again referring to FIG. 3, after the cam shaft has been assembled, the cam lobes are mechanically worked or otherwise densified in regions of the part or throughout to appropriately adjust the shape and/or dimensions of each as necessary. More particularly, in the embodiment of the invention depicted in FIG. 3, the outer surface of each cam lobe is roller burnished to compact the surface region of each cam lobe and achieve desired shape and dimensions. The mechanical working may be accomplished by, for example, roller burnishing, coining, sizing, shot peening, or laser impacting or any other suitable working technique to densify the surface region and achieve desired shape and dimensions. Preferably the cam lobes are worked by roller burnishing. Because powder metal cam lobes, especially those having the above-described composition, may be produced to near-net shape, a significant reshaping of the profile of each cam lobe may not be necessary to achieve the desired shape and dimensions. Thus, roller burnishing, which is a cold mechanical working technique and does not involve metal removal, provides distinct advantages relative to the more costly, complex, and time-consuming grinding techniques conventionally used in camshaft fabrication. Other cold working techniques would provide similar distinct advantages over grinding.

Various techniques of roller burnishing non-cylindrical parts may be employed in the method of the present invention. Essentially, roller burnishing is a cold working process using pressure rolling techniques and does not involve metal removal. Roller burnishing provides some degree of work hardening, but the primary purpose of the technique as applied in the method of the present invention is to achieve shape and dimensional accuracy. Roller burnishing is generally described at pages 252–254 of Volume 16 ("Machining") of the Metals Handbook (ASM International 1989), which pages are incorporated herein by reference. Because roller burnishing is a known process, it is not described in detail herein. The worked surface region of a cam lobe produced of powder metal material may be compressed between 0.002 inches and 0.010 inches by a roller burnishing technique. Compression of the cam lobe to greater than 0.010 inches may result in spalling of the material at the cam lobe surface or other surface damage and, therefore, is not preferred. It is believed that roller burnishing of the cam lobes according the method of the present invention may be applied to improve the tolerances of the cam lobes to the range of ±0.0003 inches on the profile.

Figure 4:
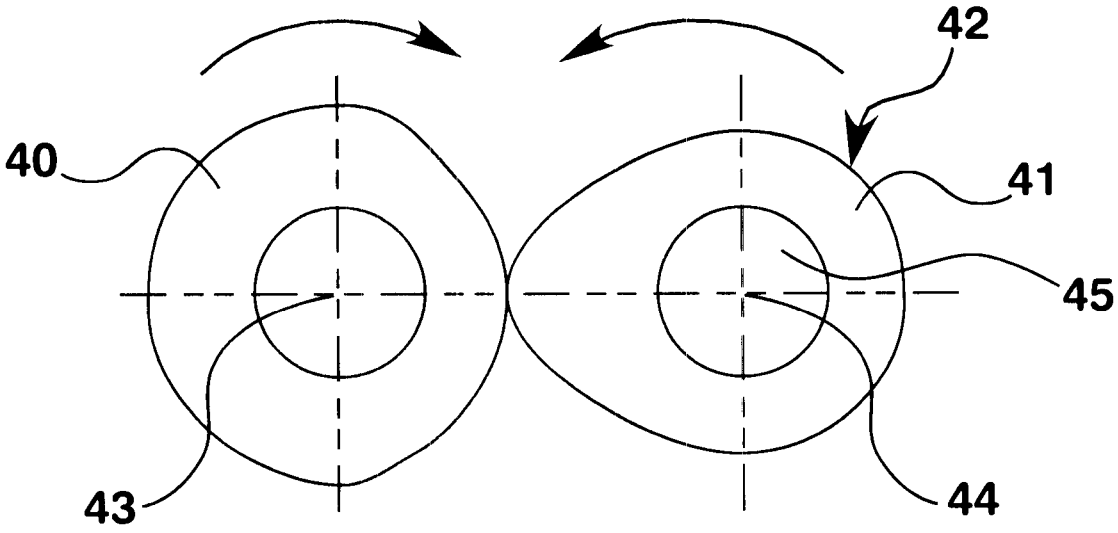
FIG. 4 is a schematic illustration of one novel technique of cam lobe roller burnishing that may be employed in the camshaft fabrication method illustrated generally in FIG. 3, and wherein a master roller is employed as a fixed roll.
Figure 5:
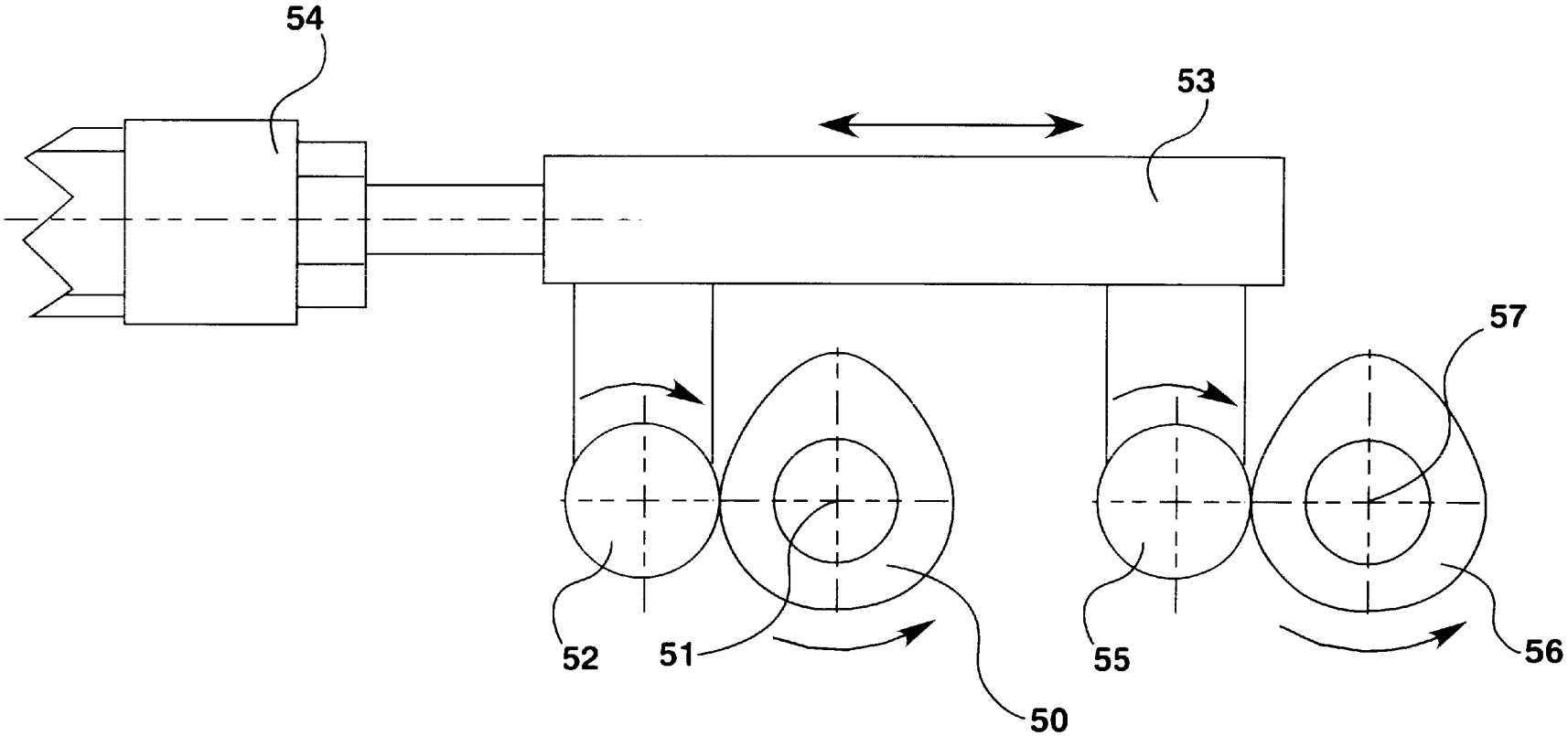
FIG. 5 is a schematic illustration of another novel technique of cam lobe roller burnishing that may be employed in the camshaft fabrication method illustrated generally in FIG. 3, and wherein both a master roller and a follower roll are employed.
Figure 6:
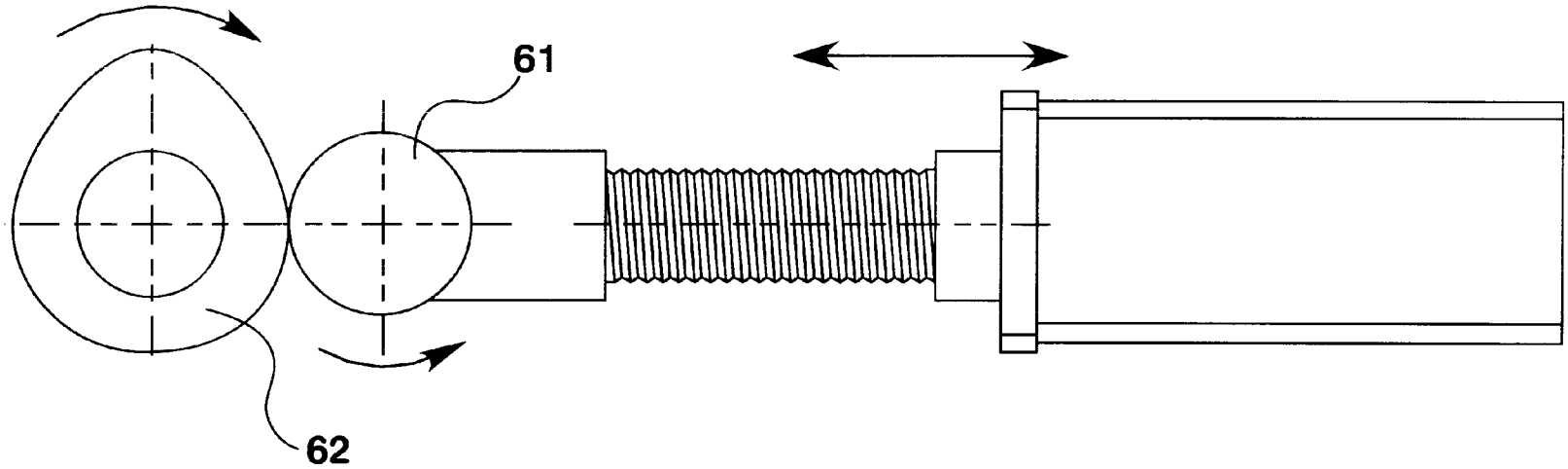
FIG. 6 is a schematic illustration of an additional alternate novel technique of cam lobe roller burnishing that may be employed in the camshaft fabrication method illustrated generally in FIG. 3, and wherein the motion of the roller is directed by computer numeric control.

Certain roller burnishing techniques specifically adapted by the inventor for use in a camshaft fabrication method within the scope of the present invention are schematically illustrated in FIGS. 4 through 6. In those techniques, the roller burnishing process is carried out with the camshaft assembled and supported to minimize the deflection of the camshaft tube.

FIG. 4 depicts one roller burnishing technique designed by the present inventor for use in the method of the present invention. The roller burnishing apparatus illustrated in FIG. 4 utilizes a fixed master roller 40. The camshaft is held in position such that as the master roller 40 turns, the camshaft also turns at an identical speed. The master roller 40 has an outer profile designed to compress and densify the outer surface region 42 of the cam lobe 41 to achieve the desired shape and profile of the cam lobe 41. In the technique shown in FIG. 4, the axes 43 and 44, respectively, about which the master roller 40 and the cam lobe 41, rotate remain equidistant. Several master rollers may be provided along axis 43 to match the spacing of the several cam lobes affixed to the outer surface of the camshaft tube 45, which are disposed along axis 44.

A second possible roller burnishing technique designed by the present inventor for use in the method of the present invention is shown in FIG. 5. The master roller 50 is in the form of a "pattern" and has the exact profile desired for the finished cam lobe. The master roller 50 rotates about a fixed axis 51 and directs a primary roller 52. Through a follower arrangement 53 mounted to a hydraulic cylinder 54, the movement of the primary roller 52 caused by rotation of the master roller 50 directs the path of the secondary roller 55, which contacts the cam lobe 56 to be roller burnished. The hydraulic cylinder 54 applies pressure to the surfaces of both the master roller 50 and the cam lobe 56. Because both the master roller 50 and the cam lobe 56 are rotatably mounted about fixed rotational axes 51 and 57, respectively, the follower arrangement acts to density the surface of the rotating cam lobe 56 to the profile of the master roller 50. As with the apparatus of FIG. 4, several master roller/primary roller/follower arrangements may be provided to match the arrangement of cam lobes along the assembled camshaft. In that way, only a single rolling operation need be carried out on each assembled camshaft to adjust the tolerances of the cam lobes. The apparatus also may be adapted to simultaneously adjust the tolerances of other components affixed to the outer surface of the camshaft tube. To the inventor's knowledge, a roller burnishing machine adapted to receive an assembled camshaft and to roller burnish, either individually or simultaneously, the cam lobes and other components affixed to the camshaft tube is heretofore unknown.

FIG. 6 depicts a third possible adaptation of roller burnishing, conceived by the present inventor, and which does not incorporate a master roller. The movement of the roller 61 is directed by computer numerical control to move in a precise pattern in the directions indicated by the double-headed arrow to appropriately shape the surface of the cam lobe 62. A series of rollers 61 may be provided, programmed for movement as necessary, to allow roller burnishing of all of the cam lobes and other components of a fully assembled camshaft in one operation.

Again referring to FIG. 3, following the roller burnishing or other densification step, the cam lobes and other components may be surface heat treated to increase the fatigue strength and wear resistance of their outer surfaces. The heat treating procedure typically involves heating the surface of the components by electromagnetic induction or flame heating to a temperature of 1400–1800° F. The heated components are then quenched in, for example, an oil or polymer quenching medium. Oil quenching typically provides less distortion and a smaller tendency toward cracking after surface quenching than polymer quenching and is, therefore, preferred. If a sinterhard powder is used to form the cam lobes, the cooling rate necessary on quenching can be substantially reduced, from an oil quench cooling rate of about 1000° F./min. down to 200° F./min. or less. The lower cooling rate would result in far less distortion and tendency to crack. The quenched parts may then be tempered to relieve stresses within the material. Preferably, the heat treatment increases the hardness of the cam lobes and other heat treated components affixed to the camshaft tube to the RC 30–60 range to enhance the wear resistance of the components.

As evidence of the advantageous fatigue and wear resistance expected of camshafts produced according to the present method, powder metal materials were prepared and tested in the following examples.

EXAMPLE 1

Powder mixes 1–4 were prepared by blending metal powders, powdered graphite, and lubricant as follows:

Powder Mix 1: 97 parts (by volume unless otherwise noted) Kobelco 46F4 iron alloy powder; 3 parts Pyron 26006 copper; 0.6 parts Southwest Graphite 1652 graphite powder; and 0.65 parts Lanza Atomized Acrawax.

Powder Mix 2: 97 parts Quebec Metal Powders 4701 iron alloy powder; 3 parts Pyron 26006 copper powder; 0.6 parts Southwest Graphite 1652 graphite powder; and 0.6 parts atomized Lanza Acrawax.

Powder Mix 3: 100 parts Hoeganaes 85 HP iron alloy powder; 0.6 parts Southwest Graphite 1652 graphite powder; and 0.65 parts Lanza Atomized Acrawax.

Powder Mix 4: 100 parts Hoeganaes 4600V non-alloy powder; 0.6 parts Southwest Graphite 1652 graphite powder; and 0.65 parts Lanza Atomized Acrawax.

Cylindrical rolling contact fatigue specimens (approximately 0.562" OD×0.245" ID×0.625" long) were molded from each of the four powders at 50 tons/in.$^2$ (tsi). The specimens were then sintered in an $N_2$ -10% $H_2$ (by volume) atmosphere at approximately 2050° F. on the belt of a belt sintering furnace for approximately 30 minutes. The sintered parts exhibited hardness levels less than RC 20 and were soft, malleable, and easily deformed. The sintered parts were next deformed to final tolerance using a mechanical working technique designed to closely simulate a commercial scale roller burnishing treatment. This was done by placing the cylindrical specimens on an arbor and running a burnishing tool over the surface of the specimens at loads sufficient to deform the slightly oversized sintered specimens to final size. In deforming the specimens, the densities of surface regions of the specimens necessarily were increased to adjust the shape and/or dimensions of the parts. Although burnishing was used to meet final tolerances, other mechanical working techniques, such as those mentioned above, could readily have been substituted to appropriately densify and deform regions of the specimens. Other possible working techniques will be readily apparent to those of ordinary skill in the art and all may be incorporated in a suitable form as the working technique in the present invention.

The deformed parts were next heat treated by re-heating into the austenite range (temperatures in excess of 1400° F.) and then rapidly cooling the heated parts to room temperature by quenching in agitated oil or by forced cooling in a gas. The quenched parts were subsequently tempered at 300–800° F. to relieve stresses and enhance strength properties. The finished specimens were rolling contact fatigue tested using the test equipment illustrated and described in U.S. Pat. No. 5,613,180, the entire disclosure of which is hereby incorporated herein by reference. The parts were evaluated for the maximum cyclic stress that would be tolerated without failure for 20 million cycles (rolling contact endurance limit). The finished parts also were tested for Rockwell C (RC) hardness on a standard Rockwell testing machine. The chemistry of the parts and the measured endurance limit and hardness values were as follows:

| Powder Mix | Ni | Mo | Cr | Cu | C | Endurance Limit (ksi) | Hardness (RC) |
|---|---|---|---|---|---|---|---|
| 1 | 0.5 | 1.0 | 0.03 | 3 | 0.5 | 264 | 36 |
| 2 | 0.07 | 0.9 | 0.30 | 3 | 0.5 | 256 | 33 |
| 3 | 0 | 0.8 | 0 | 0 | 0.55 | 347 | 43 |
| 4 | 1.8 | 0.6 | 0 | 0 | 0.4 | 288 | 33 |

Thus, the final parts exhibited hardnesses in the RC 30–RC 60 range and endurance limits well in excess of 225 ksi after the heat treatment. Such material would be particularly suited for use as cam lobes, which are subjected to large cyclic stresses and heavy loads over prolonged periods. When using the material to produce camshaft cam lobes, near net shape cam lobes would be separately produced but not subjected to the final heat treatment (quench and temper) steps until the cam lobes were affixed to the camshaft tube in proper axial positions and angular orientations using a shrink fitting technique or another suitable affixation technique.

EXAMPLE 2

A powder mix was prepared by blending 98.5 weight % Hoeganaes 4600V alloy powder (1.8% nickel-0.6% molybdenum-balance iron); 1.0 weight % Pyron 26006 copper powder; 0.5 weight % Southwest Graphite 1642 graphite powder; and 0.65 weight % Lanza Atomized Acrawax. Three samples of the powder mix were separately compacted at 50 tsi, and then sintered at 2050° F. in an $N_2$-3% $H_2$ atmosphere for about 30 minutes in a belt sintering furnace. The sintered specimens each included an aperture therethrough and were assembled about the outer surface of individual solid shafts of about 0.250 inch in diameter using a press fitting technique. The assembled specimens were mounted onto a lathe used for roller burnishing by retracting the expandable arbor of the lathe and then installing one of the 0.250 inch diameter shafts in its place. Thus, the shafts replaced the arbor during roller burnishing and simulated the installation of a cam lobe/cam shaft tube assembly on a roller burnishing machine which, as proposed herein, is specifically adapted to receive an assembled camshaft.

Once installed on the lathe, the surface of the power metal part affixed to the shaft was roller burnished to achieve desired tolerances. The parts were then induction hardened by re-heating to 1400–1600° F. for 0.5–30 seconds and then quenching in oil, followed by a 300° F. temper. The heat treated parts exhibited hardnesses of RC 33–36. During rolling contact fatigue testing, the shafts served to locate and fix the powder metal parts. Times to failure and endurance limits for the three tested parts are as follows. The endurance limits were calculated based on the load applied (500,000 psi), the diameter of the specimen (0.560 inch), the cycles per minute (approximately 1 million cycles per hour), and the time to specimen failure.

| Part | Time to Failure | Endurance limit (ksi) |
|---|---|---|
| 1 | 1 hr. 22 min. | 288 |
| 2 | 10 hr. 57 min. | 364 |
| 3 | 11 hr. 57 min. | 368 |

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

We claim:

1. A method of providing a camshaft, the method comprising:

providing a camshaft tube having an outer surface;

providing a cam lobe having an aperture therethrough sized to be received about the outer surface of the camshaft tube when said cam lobe is at a temperature greater than a predetermined temperature;

heating the cam lobe to a temperature greater than the predetermined temperature;

positioning the camshaft tube and the cam lobe so that the camshaft tube is disposed through the aperture of the cam lobe and the cam lobe is at a predetermined position and angular orientation relative to the camshaft tube;

cooling the cam lobe to a temperature below the predetermined temperature to affix the cam lobe to the outer surface of the camshaft tube at the predetermined position and angular orientation;

increasing the density of at least a region of the cam lobe to adjust at least one of the shape and the dimensions of the cam lobe.

2. The method of claim 1 wherein increasing the density of at least a region of the cam lobe comprises mechanically working at least a region of the surface of the cam lobe by at least one technique selected from roller burnishing, sizing, coining, shot peening, and laser impacting to adjust at least one of the shape and the dimensions of the cam lobe.

3. The method of claim 1 wherein providing the cam lobe comprises:

placing a metallurgical powder into a void of a mold;

consolidating the metallurgical powder within the mold to form a compact;

sintering the compact; and compressing the sintered compact.

4. The method of claim 3 wherein compressing the sintered compact comprises coining the sintered compact.

5. The method of claim 4 wherein sintering the compact comprises heating the compact to a temperature of at least 2000° C.

6. The method of claim 1 wherein the predetermined temperature is greater than 500° C.

7. The method of claim 3 wherein consolidating the metallurgical powder comprises applying pressure greater than 25 tsi to the metallurgical powder.

8. The method of claim 3 wherein sintering the compact comprises heating the compact at 2000 to 2350° C.

9. The method of claim 3 wherein compressing the sintered compact comprises applying pressure greater than 30 tsi to the sintered compact.

10. The method of claim 3 wherein the metallurgical powder comprises, in weight percent based on the total weight of the powder, 90 to 99.7 iron, 0 to 2.0 nickel, 0 to 1.0 molybdenum, 0.3 to 2.0 carbon, 0 to 3.0 copper, and 0 to 3.0 chromium.

11. The method of claim 3 wherein the hardness of the compact after sintering the compact but before compressing the compact is less than RC 20.

12. The method of claim 1 wherein the cam lobe has a density of 6.8 to 7.6 g/cc.

13. The method of claim 1 wherein increasing the density of at least a region of the cam lobe comprises compressing at least a region of a surface of the cam lobe greater than 0.002 inch.

14. The method of claim 1 wherein increasing the density of at least a region of the cam lobe comprises compressing at least a region of a surface of the cam lobe greater than 0.002 to less than 0.01 inch.

15. The method of claim 1 further comprising:

adjusting at least one of the shape and the dimensions of the camshaft tube by grinding at least a region of the outer surface of the camshaft tube.

16. The method of claim 15 wherein grinding at least a region of the outer surface of the camshaft tube comprises centerless grinding at least a region of the outer surface of the camshaft tube.

17. The method of claim 1 further comprising:

providing a plurality of additional components, each such additional component sized to be received about the outer surface of the camshaft tube when each such additional components is at a temperature greater than the predetermined temperature;

heating each such additional component to a temperature greater than the predetermined temperature;

positioning the camshaft tube and each such additional component so that the camshaft tube is disposed through the aperture of each such additional component and so that each additional component is at a desired position and angular orientation relative to the camshaft tube;

affixing each additional component about the outer surface of the camshaft tube by cooling the additional components to a temperature below the predetermined temperature.

18. The method of claim 17 wherein the additional components comprise components selected from the group consisting of gears, sprockets, bushings, and bearing.

19. The method of claim 1 wherein cooling the cam lobe comprises spraying at least one of the cam lobe and the camshaft tube with at least one of liquid nitrogen and liquid carbon dioxide.

20. The method of claim 1 wherein cooling the cam lobe comprises spraying at least one of liquid nitrogen and liquid carbon dioxide inside the camshaft tube.

21. The method of claim 1 further comprising:

heat treating at least one of the camshaft tube and the cam lobe to increase the hardness of at least a region of the surfaces of the camshaft tube and the cam lobe.

22. The method of claim 21 wherein the hardness of at least a region of the surface of the cam lobe is in the range of RC 30 to RC 60 after heat treating at least one of the camshaft tube and the cam lobe.

23. The method of claim 21 wherein heat treating at least one of the camshaft tube and the cam lobe comprises:

induction heating the camshaft tube and the cam lobe to 1400 to 1800° C.; and quenching the camshaft tube and the cam lobe in at least one of an oil and a polymer.

24. The method of claim 1 wherein the cam lobe has a density of 6.8 to 7.4 g/cc.

25. The method of claim 1 wherein the cam lobe has a density of 7.2 to 7.6 g/cc.

26. A method of providing a camshaft, the method comprising:

providing a camshaft tube having an outer surface;

providing a cam lobe;

securely affixing the cam lobe to the outer surface of the camshaft tube at a predetermined position and angular orientation; and subsequent to securely affixing the cam lobe to the outer surface of the camshaft tube, increasing the density of at least a region of the cam lobe to adjust at least one of the shape and the dimensions of the cam lobe.

27. The method of claim 24 wherein increasing the density of at least a region of the cam lobe comprises mechanically working at least a region of the surface of the cam lobe using at least one technique selected from roller burnishing, sizing, coining, shot peening, and laser impacting to adjust at least one of the shape and the dimensions of the cam lobe.

28. The method of claim 27 wherein affixing the cam lobe to an outer surface of the camshaft tube comprises shrink fitting the cam lobe about the outer surface of the camshaft tube.

29. The method of claim 24 wherein providing a cam lobe comprises:

placing a metallurgical powder into a void of a mold;

consolidating the metallurgical powder within the mold to form a compact;

sintering the compact; and compressing the sintered compact.

30. The method of claim 29 further comprising:

heat treating at least one of the camshaft tube and the cam lobe to increase the hardness of at least a region of the surfaces of the camshaft tube and the cam lobe.

31. The method of claim 30 wherein:

the hardness of a surface region of the compact is less than RC 20 after sintering the compact and before compressing the sintered compact; and the hardness of the cam lobe after heat treating at least one of the camshaft tube and the cam lobe is in the range of RC 30 to RC 60.

32. The method of claim 24 wherein affix the cam lobe to the outer surface of the cam shaft tube comprises affixing the cam lobe to the outer surface of the camshaft tube by an interference fit.

33. The method of claim 24 wherein affixing the cam lobe to the outer surface of the cam shaft tube comprises welding the cam lobe to the outer surface of the camshaft tube.

34. The method of claim 26 wherein affixing the cam lobe to the outer surface of the cam shaft tube comprises mechanically connecting the cam lobe to the outer surface of the camshaft tube.

35. The method of claim 26 wherein affix the cam lobe to the outer surface of the cam shaft tube comprises fusing the cam lobe to the outer surface of the camshaft tube.

36. The method of claim 26 wherein affixing the cam lobe to the outer surface of the cam shaft tube comprises sintering the cam lobe to the outer surface of the camshaft tube.

37. The method of claim 26 further comprising:

adjusting at least one of the shape and the dimensions of the camshaft tube by grinding at least a region of the outer surface of the camshaft tube.

38. The method of claim 37 wherein grinding at least a region of the outer surface of the camshaft tube comprises centerless grinding at least a region of the outer surface of the camshaft tube.

39. The method of claim 26 further comprising:

providing at least one additional component; and affixing each additional component to the outer surface of the camshaft tube at a predetermined position and angular orientation.

40. The method of claim 39 wherein each additional component is individually selected from the group consisting of gears, sprockets, bushings, and bearings.

41. The method of claim 30 wherein heat treating at least one of the camshaft tube and the cam lobe comprises:

induction heating the camshaft tube and the cam lobe to 1400 to 1800° C.; and quenching the camshaft tube and the cam lobe in at least one of an oil and a polymer.

42. A method of providing a camshaft, the method comprising:

providing a camshaft comprising a camshaft tube and a cam lobe securely affixed to the camshaft tube; and subsequent to providing the camshaft, increasing the density of at least a region of the cam lobe to adjust at least one of the shape and the dimensions of the cam lobe.

43. The method of claim 42 wherein increasing the density of at least a region of the cam lobe comprises mechanically working the cam lobe.

44. The method of claim 43 wherein mechanically working the cam lobe comprises at least one technique selected from roller burnishing, sizing, coining, shot peening, and laser impacting.

45. The method of claim 42 wherein increasing the density of at least a region of the cam lobe comprises compressing at least a region of the surface of the cam lobe greater than 0.002 inch.

46. The method of claim 42 wherein increasing the density of at least a region of the cam lobe comprises compressing at least a region of the surface of the cam lobe greater than 0.002 to less than 0.01 inch.

47. The method of claim 42 further comprising:

heat treating the cam lobe to increase the hardness of at least a region of the surface of the cam lobe.

48. The method of claim 47 wherein the hardness of at least a region of the surface of the cam lobe is in the range of RC 30 to RC 60 after heat treating the cam lobe.

49. The method of claim 47 wherein heat treating the cam lobe comprises:

induction heating the cam lobe to 1400 to 1800° C.; and quenching the cam lobe in at least one of an oil and a polymer.

50. A method of making a camshaft, the method comprising:

providing a camshaft tube having an outer surface;

providing a cam lobe having an aperture therethrough securely affixing the cam lobe to the camshaft by heating the cam lobe to a temperature at which the camshaft tube may be disposed through the aperture, positioning the camshaft tube through the aperture and positioning the cam lobe at a desired position and angular orientation on the camshaft tube, and cooling the cam lobe to shrink the aperture and securely affix the cam lobe to the outer surface of the camshaft tube at the predetermined position and angular orientation; and subsequent to securely affixing the cam lobe to the camshaft, increasing the density of at least a region of the cam lobe to adjust at least one of the shape and the dimensions of the cam lobe.

51. The method of claim 50 wherein increasing the density of at least a region of the cam lobe comprises mechanically working at least a region of a surface of the cam lobe.

52. The method of claim 51 wherein mechanically working at least a region of a surface of the cam lobe comprises using at least one technique selected from roller burnishing, sizing, coining, shot peening, and laser impacting.

53. The method of claim 50 wherein the a temperature at which the camshaft tube may be disposed through the aperture is greater than 500° C.

54. A method of making a camshaft, the method comprising:

securely affixing a cam lobe to an outer surface of a shaft; and subsequent to securely affixing the cam lobe to the shaft, altering at least one of the shape and the dimensions of the cam lobe by increasing the density of at least a portion of the cam lobe.

55. The method of claim 54 wherein increasing the density of at least a portion of the cam lobe comprises mechanically working the cam lobe.

56. The method of claim 55 wherein mechanically working at least a portion of the cam lobe comprises at least one technique selected from roller burnishing, sizing, coining, shot peening, and laser impacting.

57. The method of claim 54 wherein the shaft is hollow.

58. The method of claim 54 wherein affixing the cam lobe to the shaft comprises at least one technique selected from mechanically connecting the cam lobe to the shaft, fusing the cam lobe to the shaft, sintering the cam lobe to the shaft, and shrink fitting the cam lobe to the shaft.

59. A method of making a camshaft, the method comprising:

providing a camshaft including at least one cam lobe securely affixed to an outer surface of a shaft; and subsequent to providing the camshaft, altering at least one of the shape and the dimensions of the cam lobe by increasing the density of at least a portion of the cam lobe.

60. The method of claim 59 wherein increasing the density of at least a portion of the cam lobe comprises mechanically working the cam lobe.

61. The method of claim 59 wherein mechanically working at least a portion of the cam lobe comprises at least one technique selected from roller burnishing, sizing, coining, shot peening, and laser impacting.

62. The method of claim 59 wherein the shaft is hollow.

63. The method of claim 59 wherein affixing the cam lobe to the shaft comprises at least one technique selected from mechanically connecting the cam lobe to the shaft, fusing the cam lobe to the shaft, sintering the cam lobe to the shaft, and shrink fitting the cam lobe to the shaft.

64. A method of adjusting at least one of the shape and the dimensions of a camshaft, wherein the camshaft includes at least one cam lobe securely affixed to an outer surface of a shaft, the method comprising:

altering at least one of the shape and the dimensions of the cam lobe by increasing the density of at least a portion of the cam lobe.

65. The method of claim 64 wherein increasing the density of at least a portion of the cam lobe comprises mechanically working the cam lobe.

66. The method of claim 64 wherein mechanically working at least a portion of the cam lobe comprises at least one technique selected from roller burnishing, sizing, coining, shot peening, and laser impacting.

67. The method of claim 64 wherein the shaft is hollow.

68. The method of claim 64 wherein affixing the cam lobe to the shaft comprises at least one technique selected from mechanically connecting the cam lobe to the shaft, fusing the cam lobe to the shaft, sintering the cam lobe to the shaft, and shrink fitting the cam lobe to the shaft.

* * * * *

UNITED STATES PATENT AND TRADEMARK OFFICE

CERTIFICATE OF CORRECTION

PATENT NO. : 6,473,964 B1
DATED : November 5, 2002
INVENTOR(S) : Gary L. Anderson and John C. Kosco It is certified that error appears in the above-identified patent and that said Letters Patent is hereby corrected as shown below:

Column 4,
Line 42, delete “adjusts” and replace with -- adjust --

Column 11,
Line 14, delete “density” and replace with -- densify --

Column 16,
Lines 3, 14, 33 and 37, delete “24” and replace with -- 26 --
Line 44, delete “affix” and replace with -- affixing --.

Signed and Sealed this

Tenth Day of June, 2003

JAMES E. ROGAN
*Director of the United States Patent and Trademark Office*